US012497978B2

(12) United States Patent
Nobel

(10) Patent No.: US 12,497,978 B2
(45) Date of Patent: Dec. 16, 2025

(54) MANUFACTURE OF A STAGE CASING IN A HYBRID PROCESS

(71) Applicant: KSB SE & Co. KGaA, Frankenthal (DE)

(72) Inventor: Tammuz Nobel, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 0 days.

(21) Appl. No.: 18/281,021

(22) PCT Filed: Mar. 4, 2022

(86) PCT No.: PCT/EP2022/055538
§ 371 (c)(1),
(2) Date: Sep. 8, 2023

(87) PCT Pub. No.: WO2022/189287
PCT Pub. Date: Sep. 15, 2022

(65) Prior Publication Data

US 2024/0141918 A1 May 2, 2024

(30) Foreign Application Priority Data

Mar. 9, 2021 (DE) ..... 10 2021 105 623.3

(51) Int. Cl.
*F04D 29/44* (2006.01)
*F04D 17/12* (2006.01)
*F04D 29/62* (2006.01)

(52) U.S. Cl.
CPC ..... *F04D 29/44* (2013.01); *F04D 17/12* (2013.01); *F04D 29/62* (2013.01)

(58) Field of Classification Search
CPC .. F04D 17/12–14; F04D 29/44; F04D 29/441; F04D 29/444; F04D 29/445; F04D 29/448
See application file for complete search history.

(56) References Cited

U.S. PATENT DOCUMENTS

2013/0039769 A1* 2/2013 Giannozzi ..... F04D 29/2227 416/185
2017/0030377 A1 2/2017 Huth et al.
2017/0218969 A1 8/2017 Boehm et al.
2019/0022753 A1 1/2019 Burbaum et al.
(Continued)

FOREIGN PATENT DOCUMENTS

DE 39 12 279 C2 1/1991
DE 10 2014 215 089 A1 2/2016
DE 10 2016 201 838 A1 8/2017
(Continued)

OTHER PUBLICATIONS

Translation of DE102018218989 (Year: 2020).*
(Continued)

*Primary Examiner* — Brian O Peters
(74) *Attorney, Agent, or Firm* — Crowell & Moring LLP

(57) ABSTRACT

A centrifugal pump includes at least one impeller. The at least one impeller is surrounded by a casing. The casing includes at least one guide device. The at least one guide device is constructed as a hybrid component. The hybrid component includes at least one conventionally manufactured constituent and at least one generatively manufactured constituent.

12 Claims, 3 Drawing Sheets

(56) References Cited

U.S. PATENT DOCUMENTS

| | | | |
|---|---|---|---|
| 2019/0313878 | A1 | 10/2019 | Dries |
| 2022/0163037 | A1 | 5/2022 | Amann et al. |

FOREIGN PATENT DOCUMENTS

| | | | | | |
|---|---|---|---|---|---|
| DE | 10 2016 205 976 | A1 | | 10/2017 | |
| DE | 10 2016 015 359 | A1 | | 6/2018 | |
| DE | 10 2018 218 989 | A1 | | 5/2020 | |
| DE | 10 2019 001 882 | A1 | | 9/2020 | |
| GB | 2062138 | A | * | 5/1981 | ..... B62M 9/1342 |

OTHER PUBLICATIONS

International Search Report (PCT/ISA/210) issued in PCT Application No. PCT/EP2022/055538 dated Jun. 21, 2022 with English translation (5 pages).

German-language Written Opinion (PCT/ISA/237) issued in PCT Application No. PCT/EP2022/055538 dated Jun. 21, 2022 with English translation (8 pages).

German-language Search Report issued in German Application No. 10 2021 105 623.3 dated Apr. 4, 2022 with partial English translation (11 pages).

* cited by examiner

PRIOR ART

MANUFACTURE OF A STAGE CASING IN A HYBRID PROCESS

CROSS REFERENCE TO RELATED APPLICATIONS

This application claims priority under 35 U.S.C. § 119 from German Patent Application No. 102021105623.3, filed Mar. 9, 2021, the entire disclosure of which is herein expressly incorporated by reference.

BACKGROUND

The disclosure relates to a centrifugal pump having at least one impeller which is surrounded by a casing, wherein the casing comprises at least one guide device.

Pumps are described as multi-stage when a plurality of impellers are arranged one after the other and the delivery stream flows through the impellers in series. The delivery height of a single-stage centrifugal pump is determined substantially by the design of the impeller and the circumferential speed. If the rotational speed cannot be increased further due to other boundary conditions and/or if an increase in the impeller diameter leads to very low specific rotational speeds and thus to uneconomic degrees of efficiency, the delivery height can be increased even from an economic point of view by connecting a plurality of stages one after the other. By changing the number of stages while otherwise maintaining the dimensions and rotational speeds, the delivery stream of such a multi-stage pump does not change, while the power requirement and the delivery height behave proportionally to the number of stages.

Guide devices in most cases have guide vanes. Guide channels for the pumped medium are formed between the guide vanes. Such guide devices can be in the form of guide wheels. Pumped medium leaving the impeller enters the guide device. In the guide device, kinetic energy is converted into pressure energy. A deflection of the medium further takes place. The swirl is optionally reduced for an approach flow to a further pump stage.

DE 39 12 279 C2 describes a centrifugal pump of the single- or multi-stage type having at least one impeller. A guide wheel is arranged downstream of the impeller in the flow direction. The guide wheel has a plurality of guide vanes.

An example of a pump having a plurality of identical stage casings connected one after the other in a tandem arrangement is a ring section pump. This type is frequently used in power plant technology, for example as a boiler feed pump, and in industrial applications in which a high delivery pressure is required.

Such centrifugal pumps, which are also known as double casing or barrel casing pumps, are centrifugal pumps which are surrounded by a barrel-like casing. The barrel casing, which is provided with suction and discharge nozzles, is closed in a plane lying perpendicular to the shaft by a cover. Such pumps are usually multi-stage pumps for use as high-pressure and maximum-pressure pumps. Within the barrel casing, a plurality of stage casings are arranged in series one after the other in the axial direction. Each stage casing comprises a pump impeller and optionally a stationary guide wheel.

The individual stage casings are usually formed together with the pump shaft as a coherent pump insertion module. The flow transition from the last guide wheel or the last stage casing into the discharge nozzle generally takes place by way of a flow space formed in the barrel casing. DE 10 2019 001 882 A1 describes such a centrifugal pump, in which an inner contour in the spiral flow space can achieve an increase in the efficiency in the last pump stage.

The guide wheels and in particular the guide devices are distinguished by a solid construction which is not very filigree, which in most cases is produced by reshaping processes and primary shaping processes. The increase in the efficiency of the pump is limited by the solid form of the guide elements, which is not optimized in terms of flow. In particular when used continuously as a boiler feed pump, small increases in the efficiency have a major economic impact.

SUMMARY

The object of the disclosure is to provide a centrifugal pump, also a multi-stage centrifugal pump, having optimized flow guidance. The centrifugal pump is to have the highest possible efficiency. Flow separation is largely to be prevented. Furthermore, retardation with the lowest possible losses is to be ensured. The centrifugal pump is to be able to be individually configured to customers' requirements. This centrifugal pump is to consist of as few individual parts as possible and is to be as easy as possible to assemble. The substitution of replacement parts is to be facilitated by the construction of the centrifugal pump. The centrifugal pump is to be able to be produced simply and inexpensively.

This object is achieved according to the disclosure by a centrifugal pump having at least one impeller. Preferred variants are to be found in the dependent claims, the description and the drawings.

According to the disclosure, the guide element of a centrifugal pump is constructed with at least one impeller, which is surrounded by a casing, as a hybrid component comprising at least one conventionally manufactured constituent and at least one generatively manufactured constituent.

A generatively manufactured constituent has been produced by a generative manufacturing process. The term generative manufacturing process includes all manufacturing processes in which material is applied layer by layer and three-dimensional components are thus produced. The layerwise buildup takes place under computer control from one or more liquid or solid materials according to predefined dimensions and shapes. Physical or chemical curing or melting processes take place during the buildup. Typical materials for 3D printing are plastics materials, synthetic resins, ceramics, metals, carbon materials and graphite materials.

Generative or additive manufacturing processes are understood as being processes in which material is applied layer by layer in order to produce a three-dimensional component. According to the disclosure, the guide elements of the guide device are in the form of generatively manufactured constituents. The guide elements are formed in particular using selective laser melting and cladding, which is also known as buildup welding. In an alternative variant of the disclosure, a process which can also be used is cold gas spraying and extrusion in combination with the application of meltable plastics material.

In selective laser melting, the guide element is produced by a process in which a layer of a buildup material is first applied to a substrate. The buildup material for producing the guide element of the guide device is preferably metallic powder particles. In a variant of the disclosure, iron-containing and/or cobalt-containing powder particles are used for this purpose. These can contain additives such as chromium, molybdenum or nickel. The metallic buildup material is applied in powder form in a thin layer to a plate. The powdered material is then locally melted completely at the desired locations by means of radiation and, after solidification, a solid material layer forms. The substrate is then lowered by the amount of a layer thickness and powder is applied again. This cycle is repeated until all the layers have been produced and the finished guide element has been formed. According to the disclosure, a structure is here produced which is particularly filigree and optimized in terms of flow and which technically cannot be produced by conventional processes.

There can be used as the radiation, for example, a laser beam which generates the guide element from the individual powder layers. The data for guiding the laser beam are generated by means of software on the basis of a 3D CAD body. Alternatively to selective laser melting, an electron beam (EBN) can also be used.

In buildup welding or cladding, the guide element is produced by a process which coats a base structure by welding. By means of a filler metal in the form of a wire or a powder, buildup welding constructs a volume which produces a form of the guide element which is particularly filigree and optimized in terms of flow.

For the use of multi-section high-pressure centrifugal pumps and boiler feed pumps, it has hitherto not been possible to use generatively manufactured guide devices because their dimensions were technically not achievable or achievable only with difficulty. Generatively manufactured guide devices are distinguished by hydraulically optimized geometries, which cannot be achieved by cutting or casting manufacturing processes. The formation of a hybrid guide device by means of a plurality of generatively manufactured guide elements which are fitted to conventionally manufactured constituents permits on the one hand a hydraulically optimized geometry and on the other hand component sizes which exceed the known manufacturing dimensions that are possible by generative methods.

According to the disclosure, the guide device has more than two, preferably more than three, in particular more than four, and/or less than twenty-four, preferably less than twenty-two, in particular less than twenty, generatively manufactured guide elements. Advantageously, a hybrid guide device which consists of a plurality of generatively manufactured and hydraulically optimized guide elements can thus be generated. The component size of a guide element can be produced by the common generative processes with all their advantages and, owing to the hybrid construction with conventional constituents, can also reach very large dimensions.

Advantageously, the generatively manufactured constituent, in particular the guide element, has an outwardly curved shape. The guide element is hydraulically optimized in terms of its shape by CFD and deflects the flow while reducing the swirl without flow separation and without vortex buildup. The radially curved shape of the guide element guides the flow to the next pump stage in a particularly ideal manner.

In a particularly advantageous embodiment of the disclosure, the generatively manufactured constituent, in particular the guide element, has formations for flow guidance. These are shaped portions and rounded portions of the guide element which are particularly filigree and which optimize the hydraulic efficiency of the pump in a very advantageous manner. They allow the flow to be deflected to the next pump stage and ideally reduce the swirl of the flow.

A front shaped portion receives the flow discharge from the radial impeller and guides it in a particularly low-loss manner to a second shaped portion, which together with the guide plate and the adjacently arranged guide elements form a flow channel. The fluid flows in a particularly swirl-free manner from this channel to the impeller arranged downstream. Ideally, the shaped portions of the guide elements can be configured, as a result of the generative manufacture, to be particularly thin and to have fine radii of curvature, which is not known of conventionally manufactured guide elements.

According to the disclosure, the generatively manufactured constituent, in particular the guide element, surrounds a guide plate almost without any gaps. Erroneous flows and efficiency losses are thus avoided. The generative manufacture of the guide elements permits extremely precise and accurate manufacture and thus gap-free fitting to the conventionally manufactured constituents of the hybrid guide device.

Ideally, a generatively manufactured constituent, in particular the guide element, has sealing elements for gap-free connection to a guide plate. The generative manufacturing process permits a finely designed geometry of the guide element, so that, when the hybrid elements of the guide device are brought together, a gap-free connection can be produced, whereby the efficiency of the centrifugal pump can optimally be developed.

In an alternative variant of the disclosure, the walls of the guide elements are very thin and the guide elements have an inner lattice structure for increasing their strength. In this advantageous manner, guide elements having a particularly excellent ratio of mass to component volume can be achieved. Specifically in comparison to conventionally manufactured guide devices, the hybrid form of the guide devices has an extremely low mass.

In a particularly advantageous embodiment of the disclosure, the hybrid construction of the guide device requires no additional joining technique. According to the disclosure, the generatively manufactured constituent, in particular the guide element, has elements for engaging into counter-elements. For example, short cylindrical pins can be formed on the guide element, which pins can be inserted into corresponding negatives on the conventional constituent and thus form a stable association. Assembly of the centrifugal pump is thus simplified considerably, because the components of the hybrid guide device can simply be fitted together.

The term conventional constituent denotes a constituent that is produced by means of primary shaping, reshaping or a subtractive manufacturing process. Primary shaping is a main group of manufacturing processes in which a solid body which has a geometrically defined shape is produced from a shapeless material. Primary shaping is used to produce the initial shape of a solid body and to create material cohesion. In the case of reshaping, blanks of plastically deformable materials are purposively brought into a different shape without removing material from the blanks. In the subtractive manufacturing process, some material is removed from the workpiece. In addition to the component that is produced, chips are primarily formed.

According to the disclosure, at least one conventionally manufactured constituent is in the form of a casing cover. In particular in the case of barrel casing pumps, the construction is simplified considerably if the guide device at the same time comprises the casing. The number of components required and assembly are reduced considerably.

Advantageously, a conventionally manufactured constituent is in the form of a guide plate. Simple plates can be produced particularly economically and precisely by casting. The hybrid construction of the guide device combines components which in each case have been produced in a hydraulically optimized manner by the most advantageous manufacturing process, to form a device which achieves the best possible efficiency of a multi-stage centrifugal pump.

Ideally, at least one conventionally manufactured constituent, in particular the guide plate, has counter-elements for the engagement of elements. For example, the counter-elements can be in the form of cylindrical recesses into which the pin-like elements of the guide elements engage and thus achieve the plug-in connection between the guide elements and the guide plate. Assembly of the hybrid guide device can thus be implemented particularly simply and efficiently in terms of time.

In an alternative variant, the generatively manufactured constituents and the conventionally manufactured constituents are joined by a non-releasable connection, preferably a welded connection, to form a guide device. Such a connection is distinguished by its robust and durable form.

In the case of joining, two or more solid bodies, the parts to be joined, having a geometrically defined shape are permanently connected. In the case of welding, a non-releasable connection of the guide elements and the guide plate is produced by the application of heat and/or pressure, with or without filler materials. The filler materials are usually supplied in the form of bars or wires, are melted and solidify in the joint between the join partners in order thus to produce the bond. Welding is one of the substance-to-substance bonding methods, wherein bonds having a high strength are produced.

It is particularly advantageous to manufacture also large, hybrid guide devices by means of an integrative, additive manufacturing process. The casing covers and the guide plate are first formed by primary shaping and/or cutting. The guide elements are produced by means of a generative process. The hybrid guide device is completed by fitting the guide plate together with the guide elements within the casing covers.

The buildup material for producing the contact face with the flowing fluid of the guide elements is preferably metallic powder particles. In a variant of the disclosure, iron-containing and/or cobalt-containing particles are used for this purpose. They can contain additives such as, for example, chromium, molybdenum or nickel.

According to the disclosure, the guide elements of the guide device are formed in an additive manufacturing process. The 3D form of a guide element is stored in software as a dataset. A robotic arm fitted with tools of different additive processes works at the locations at which the guide element is to be formed and forms, layer by layer, the contact face with the flowing medium and the supporting lattice structure of the contact faces. Advantageously, the suitable buildup process for each buildup material can be carried out for each layer in succession or simultaneously, so that a complex guide element of different materials is formed, the regions of which are optimally adapted to the requirements of its subsequent use.

In a variant of the disclosure, a lattice structure is produced by means of the melt-layer tool of the additive manufacturing process, in which a grid pattern of points is applied from meltable plastics material to a surface. By extrusion by means of a nozzle and subsequent curing by cooling at the desired position, a load-bearing structure, in particular in the form of a lattice and/or in the form of honeycombs, is produced. Because the supporting region of a guide element is produced so as to form voids and with a particularly high load-bearing capacity, a guide element has considerable strength and at the same time a low mass. A guide element is usually built up in that a working plane is travelled over repeatedly, in each case line by line, and then the working plane is moved upward in a stacking manner, so that the supporting region of a guide element is formed.

In a particularly advantageous variant of the disclosure, the contact face with the flowing fluid of the guide element is produced from a buildup material by successive melting and solidification of layers by means of radiation. The different properties of the regions of a guide element are here generated by variations of the radiation. By purposively controlling the local introduction of heat, a modification of the material properties is effected even during buildup of the guide element. As a result, it is possible to produce, in one region of the guide element, zones and microstructures of different material states of a chemically homogeneous material, and thus different properties.

The metallic buildup material is applied in powder form in a thin layer to a plate. The powdered material is locally melted completely at the desired locations by means of radiation and, after solidification, forms a solid material layer. This base plate is then lowered by the amount of a layer thickness and powder is applied again. This cycle is repeated until all the layers have been produced. Excess powder is cleaned from the finished guide element.

The process according to the disclosure is distinguished in that guide devices can be configured particularly individually. Adaptations of the guide device according to the requirements of the centrifugal pump can be taken into consideration by the generative manufacture. Expensive individual manufacture becomes significantly more cost-effective as a result of the comparatively low-cost, hybrid configuration of conventionally and generatively manufactured constituents. In addition, the generatively manufactured constituent can have a shape which can achieve a higher pump efficiency and has hitherto not been achievable by conventional manufacturing methods.

Ideally, the guide device, which is produced in hybrid form from a generatively manufactured constituent and at least one conventionally manufactured constituent, is used as the guide device for a centrifugal pump, in particular for a high-pressure ring section pump. The guide device is distinguished by excellent fluid-mechanical properties.

Advantageously, by connecting the guide device according to the disclosure comprising a casing cover and the corresponding impellers one after the other, a multi-stage high-pressure ring section pump can be formed. This series connection can flexibly be shortened or lengthened and thus adapted to changes during operation.

Further features and advantages of the disclosure will become apparent from the description of exemplary embodiments with reference to the drawings and from the drawings themselves, in which:

DETAILED DESCRIPTION

Figure 1:
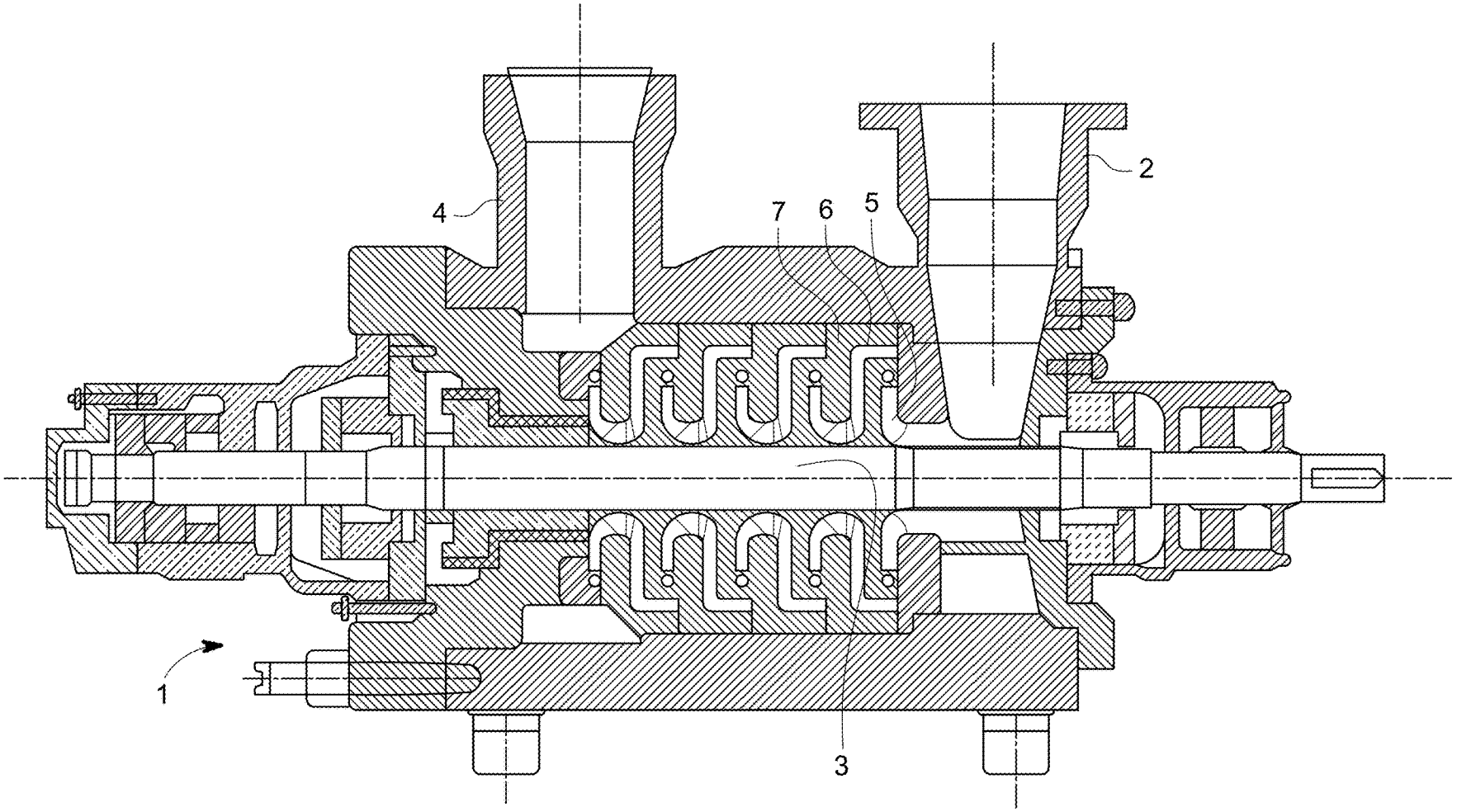
FIG. 1 depicts a multi-stage centrifugal pump according to the prior art.

FIG. 1 shows a known multi-stage centrifugal pump 1 in a horizontal set-up. A vertical or oblique set-up is likewise possible. In this embodiment variant, the shaft 3 is equipped with five impellers. The fluid flows into the pump inlet 2 and leaves the pump by way of the pump outlet 4. A fluid to be pumped, for example a readily outgassing or combustible fluid having a low boiling point, flows in the direction toward the first pump stage having an impeller 5 of the radial type. This first impeller 5, which acts as a suction impeller, conveys into a guide device 6, wherein the impeller 5 and the guide device 6 are surrounded by a casing 7. The casing 7 and the guide device 6 form a unit in the form of a barrel casing, which gives the barrel casing pump its name. The guide device 6 comprises return guide vanes with which the fluid is conveyed to a further pump stage having a further impeller. An impeller and a guide device in each case form a unit, a so-called pump stage, in the multi-stage pump assembly.

Figure 2:
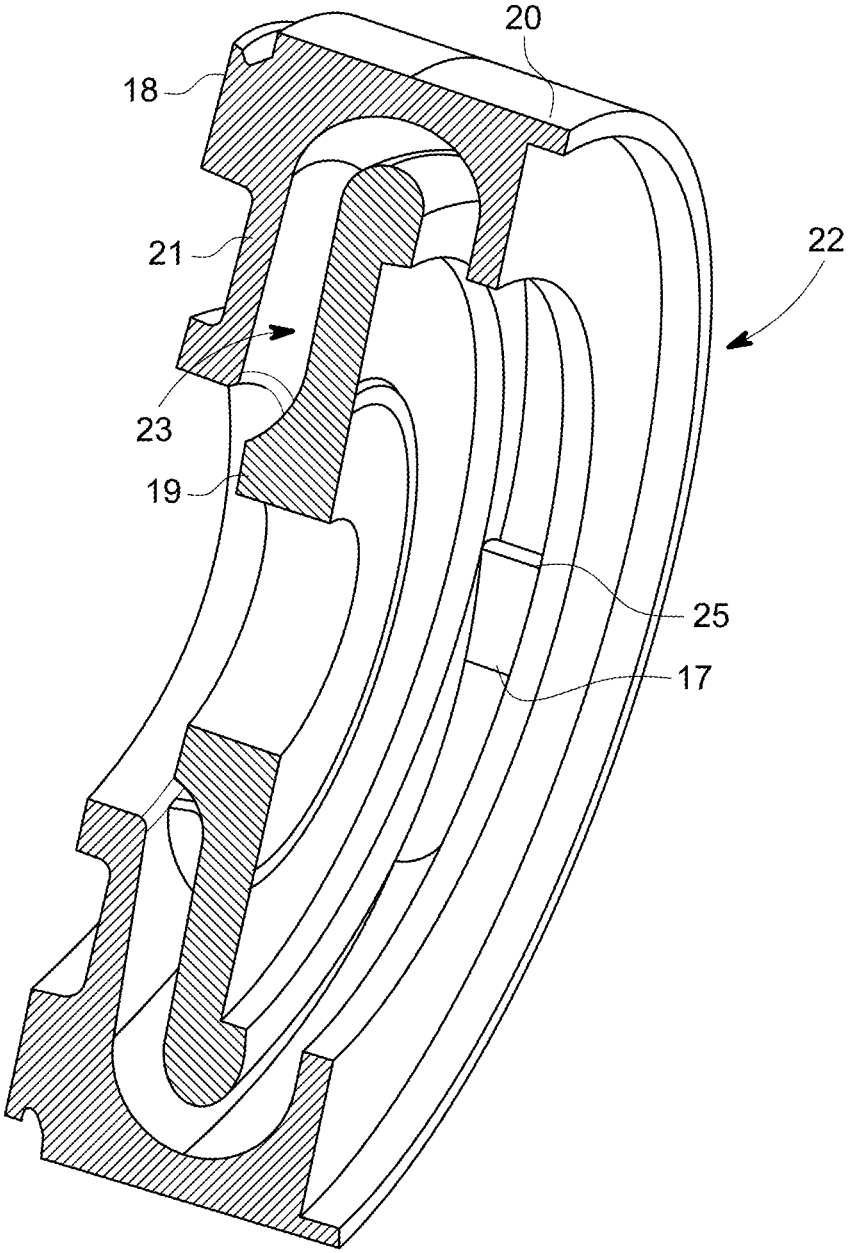
FIG. 2 depicts a perspective sectional view of a guide device.

FIG. 2 shows a perspective section through the guide device 23 according to the disclosure. The guide device 23 comprises the casing covers 18 and 20, which form part of the centrifugal pump casing 22. The casing cover 18 has counter-elements 21 into which elements 24 (not shown in this figure) engage. The guide device 23 further comprises the guide plate 19 and, by way of example, one guide element 17. The guide device 23 according to the disclosure comprises more than two, preferably more than three, in particular more than four, and/or less than twenty-four, preferably less than twenty-two, in particular less than twenty, generatively manufactured guide elements 17.

The casing cover 20 radially surrounds an impeller (not shown) completely and receives the fluid discharge of the impeller. The guide elements 17 deflect the fluid flow by their radially outwardly curved shape and the formations for flow guidance 25, while reducing the swirl. As a result of their optimized flow shape, the guide elements 17 avoid vortex buildup and flow separations and thus contribute to increasing the efficiency of the centrifugal pump 1.

The guide device 23 is a hybrid component which consists of the conventionally manufactured parts, the guide plate 19 and the casing covers 18 and 20, and the generatively manufactured guide element 17. The hybrid construction of the guide device 23 thus combines the advantages of each manufacturing process in order to achieve the optimal efficiency of the centrifugal pump 1 according to the disclosure.

Figure 3:
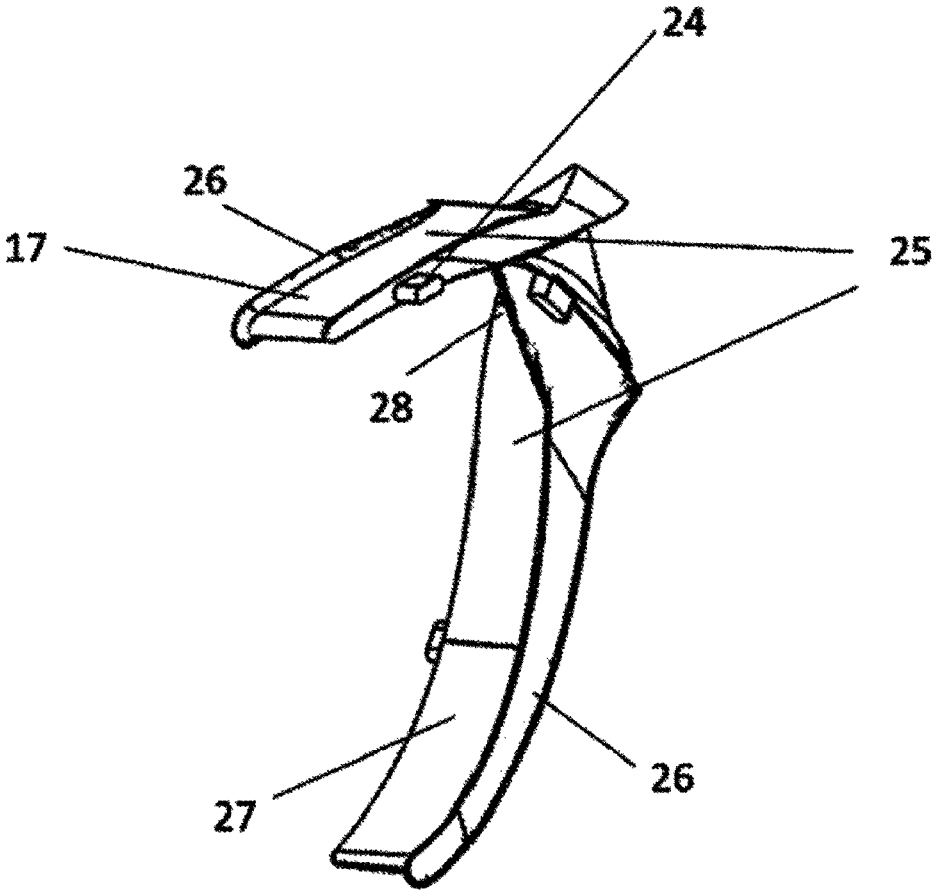
FIG. 3 depicts a schematic representation of a guide element.

FIG. 3 shows a schematic representation of the guide element 17 with its radially outwardly curved shape. The generatively manufactured guide element 17 has formations 25 for improved flow guidance, and sealing elements for gap-free connection to the guide plate 19 (not shown). The elements 24 for engaging into the counter-elements 21 (not shown) permit the plug-in design of the guide device 23 of hybrid form.

A front formation 27 of the guide element 17 receives the flow discharge from the upstream impeller (not shown) and guides it in a particularly low-loss manner to a second shaped portion 28 which, together with the guide plate 19 shown in FIG. 2 and adjacently arranged guide elements 17, form flow channels. The fluid flows in a particularly swirl-free manner from such a channel to the impeller arranged downstream. Owing to the generative manufacture, the shaped portions 25 of the guide element 17 are particularly thin and have fine radii of curvature, whereby the overall efficiency of the centrifugal pump can be significantly increased.

The foregoing disclosure has been set forth merely to illustrate the disclosure and is not intended to be limiting. Since modifications of the disclosed embodiments incorporating the spirit and substance of the disclosure may occur to persons skilled in the art, the disclosure should be construed to include everything within the scope of the appended claims and equivalents thereof.

The invention claimed is:

1. A centrifugal pump comprising:

at least one impeller which is surrounded by a casing, wherein the casing comprises at least one guide device, the at least one guide device is constructed as a hybrid component comprising:

at least one conventionally manufactured constituent, and at least one generatively manufactured constituent, wherein the at least one generatively manufactured constituent is a guide element, at least one conventionally manufactured constituent has counter elements, the at least one generatively manufactured guide element has elements configured to engage with the counter elements to form a plug-in connection, and in a fully assembled state, the guide device has a plug-in configuration that enables positioning and coupling of the guide elements without the use of threaded fasteners.

2. The centrifugal pump as claimed in claim 1, wherein the guide device has more than two guide elements and/or less than twenty-four generatively manufactured guide elements.

3. The centrifugal pump as claimed in claim 2, wherein a generatively manufactured constituent has a radially outwardly curved shape.

4. The centrifugal pump as claimed in claim 3, wherein a generatively manufactured constituent has formations configured to guide flow.

5. The centrifugal pump as claimed in claim 4, wherein a generatively manufactured constituent surrounds a guide plate without any gaps.

6. The centrifugal pump as claimed in claim 5, wherein a generatively manufactured constituent has sealing elements configured to connect to the guide plate in a gap-free manner.

7. The centrifugal pump as claimed in claim 1, wherein at least one conventionally manufactured constituent is configured as a casing cover.

8. The centrifugal pump as claimed in claim 7, wherein a conventionally manufactured constituent is configured as a guide plate.

9. The centrifugal pump as claimed in claim 1, wherein the guide device has return guide vanes, configured to convey fluid to a further pump stage having an impeller.

10. A method comprising:

using a hybrid component having at least one generatively manufactured constituent and at least one conventionally manufactured constituent as a casing having an integrated guide device for a centrifugal pump, wherein the at least one generatively manufactured constituent is a guide element, at least one conventionally manufactured constituent has counter elements, the at least one generatively manufactured constituent guide element has elements configured to engage with the counter elements to form a plug-in connection, and in a fully assembled state, the guide device has a plug-in configuration that enables positioning and coupling of the guide element without the use of threaded fasteners.

11. A method for manufacturing a centrifugal pump via an integrative manufacturing unit, as claimed in claim 1, the method comprising:

forming the casing cover and/or a guide plate by primary shaping and/or cutting;

forming the guide elements by a generative process;

fitting the guide elements, the guide plate and the casing covers together to form a guide device, produced in a hybrid manner, of a centrifugal pump casing.

12. The method as claimed in claim 10, wherein the guide device has return guide vanes, configured to convey fluid to a further pump stage having an impeller.

* * * * *